US005498209A

United States Patent [19]

Arutunian

[11] Patent Number: 5,498,209

[45] Date of Patent: Mar. 12, 1996

[54] AUTO-ADJUSTING FINGER INSERTS FOR A BOWLING BALL

[76] Inventor: Tom Arutunian, 16291 Sundancer La., Huntington Beach, Calif. 92649

[21] Appl. No.: 444,441

[22] Filed: May 19, 1995

[51] Int. Cl.[6] ..... A63B 43/02

[52] U.S. Cl. ..... 473/128; 473/129

[58] Field of Search ..... 473/125, 126, 473/127, 128, 129, 130

[56] References Cited

U.S. PATENT DOCUMENTS

| | | | |
|---|---|---|---|
| 2,372,958 | 4/1945 | Keith . | |
| 2,842,367 | 7/1958 | Keith . | |
| 3,004,762 | 10/1961 | Frost . | |
| 3,012,783 | 12/1961 | Bunk et al. . | |
| 4,432,546 | 2/1984 | Allen, Jr. | 473/129 |
| 4,560,162 | 12/1985 | Miller . | |
| 4,778,178 | 10/1988 | Haza . | |
| 5,176,378 | 1/1993 | Bernhardt | 473/128 |
| 5,308,061 | 5/1994 | Bernhardt | 473/127 |
| 5,330,392 | 7/1994 | Bresin et al. . | |

OTHER PUBLICATIONS

"Contour–Power", *Bowling*, Aug./Sep. 1990, p. 47.

*Primary Examiner*—William M. Pierce
*Attorney, Agent, or Firm*—Price, Gess & Ubell

[57] ABSTRACT

A simple and inexpensive bowling ball finger hole insert provides a firm finger grip that automatically adjusts to accommodate changes in a bowler's finger diameter. The insert has a substantially cylindrical shape and is manufactured from an elastomer such as polyurethane. The outer dimensions of the insert are selected to match a standard hole in a bowling ball. The insert comprises two coaxial hollow cylinders of different diameters. The outer cylinder fits into the ball's finger hole and contacts the ball, while the smaller inner cylinder, which is sized to accept the bowler's finger, is suspended within the outer cylinder with an air space between the two cylinders. When the inner cylinder deforms to accept a finger with an enlarged diameter, it expands into the air space. The inner cylinder can be suspended within the air space by being attached to the outer cylinder either laterally along one side or distally at the end of the inner cylinder.

13 Claims, 1 Drawing Sheet

AUTO-ADJUSTING FINGER INSERTS FOR A BOWLING BALL

BACKGROUND OF THE INVENTION

1. Field of the Invention

The present invention generally relates to a finger insert to permit improved grip and, more particularly, to finger inserts for use in the holes of a bowling ball.

2. Description of Related Art

The precise fit of a bowling ball to a bowler's fingers has long been a sore spot in this popular sport. It stands to reason that a player's grip on the ball must be sure and secure so that the ball is correctly aimed and propelled down the alley. If the holes into which one inserts one's fingers to grip the ball are too large, the ball may well slip prematurely from one's grasp. The extra effort to hold on to a loose ball may be significant. But if the holes are too small, the player's fingers may become sore and bruised through repeated insertions into the holes. The ball may even hang on to the hand for a moment after release, resulting in further finger damage, as well as gutter balls.

As a result, the usual tradition for serious bowlers has been to obtain a custom-made ball in which the holes are drilled to match the bowler's fingers. Generally, such custom holes are available in 1/32-inch increments, making it possible to closely match the dimensions of a bowler's fingers. However, the human finger is not static. It may swell due to bruising, weight gain, or even to water retention. On the other hand., the finger may shrink due to weight loss. Fingers frequently change diameter during the course of the day; perhaps being smaller in the morning and larger in the evening. In any case, a bowling ball hole that matches the fingers perfectly when it was first drilled may well be too large or too small at a later date. In fact, it is likely that the same hole will alternately be too large and too small.

Some bowlers attempt to solve the changing finger size problem by having more than one bowling ball: say one ball drilled for their fingers at their minimum size and a second ball drilled for the fingers at a maximum size. This solution is not very practical, particularly for a casual player who uses rental balls. Therefore, there has been a considerable inventive effort expended in trying to solve this vexing problem.

A number of special bowling balls that have adjustable finger holes have been disclosed. U.S. Pat. No. 2,372,958 to Keith discloses a finger hole which includes a hollow cylinder of rubber or similar resilient material. The bowler's finger is inserted into the hollow cylinder, and an adjustable compressing device is provided which compresses the hollow cylinder lengthwise, thereby causing the hollow cylinder to decrease in diameter. U.S. Pat. No. 3,012,783 to Bunk shows a bowling ball with a hollow cylindrical insert of flexible material. The insert is compressed to alter its diameter much like '958 to Keith. However, in this device the insert is compressed from its bottom end, whereas the compression in Keith is from the top end.

U.S. Pat. No. 3,004,762 to Frost shows another adjustable insert comprising a hollow cylinder with a longitudinal split in its lateral wall. An adjustment screw presses laterally on the insert, compressing it and reducing the effective size of the finger hole.

U.S. Pat. No. 4,560,162 to Miller discloses an adjustable thumb insert for a bowling ball. A screw is provided which causes a movable shoulder to slide along an inclined plane, forcing the shoulder inward, and thereby narrowing the effective diameter of the insert. Alternatively, a screw rotates an eccentric cam that presses into and decreases the diameter of the thumb insert. U.S. Pat. No. 4,778,178 to Haza show a different way to use an incline plane to adjust an insert. The insert comprises two telescoped tubes with an inclined plane ramp portion between them. Means is provided to rotate the ramp relative to the stationary tubes. The ramp interacts with a portion of the inner tube variably pressing it inward, thereby adjusting the finger hole diameter.

U.S. Pat. No. 2,842,367 to Keith discloses a bowling ball finger insert which is molded of rubber and contains a plurality of hollow compartments within its lateral walls. The insert is designed so that one or more of the compartments can be inflated with air, thereby adjusting the diameter of the finger opening.

U.S. Pat. No. 5,330,392 to Bresin et al. provides an insert of resilient material having concave recesses or flutes in its outer wall. This allows the recesses to collapse under pressure from an inserted finger, thereby automatically adjusting itself to the size of an inserted finger.

SUMMARY OF THE INVENTION

The present invention aims to provide a simple and inexpensive bowling ball finger hole insert that provides a firm finger grip while automatically adjusting to accommodate changes in the bowler's finger size. This is accomplished by providing an insert of a substantially cylindrical shape manufactured from an elastomeric polymer such as polyurethane. The outer dimensions of the insert are selected to match a standard hole in a bowling ball. The insert comprises two coaxial hollow cylinders of different diameters. The outer cylinder fits into the ball's finger hole, while the smaller inner cylinder, which is sized to accept the bowler's finger, is suspended within the outer cylinder with an air space between. When the inner cylinder is deformed by accepting an enlarged finger, it expands into the air space. The inner cylinder can be suspended within the air space by being joined to the outer cylinder either along one side or at its distal end.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide automatically-adjusting bowling ball inserts comprising two coaxial hollow cylinders of elastomer.

Figure 1:
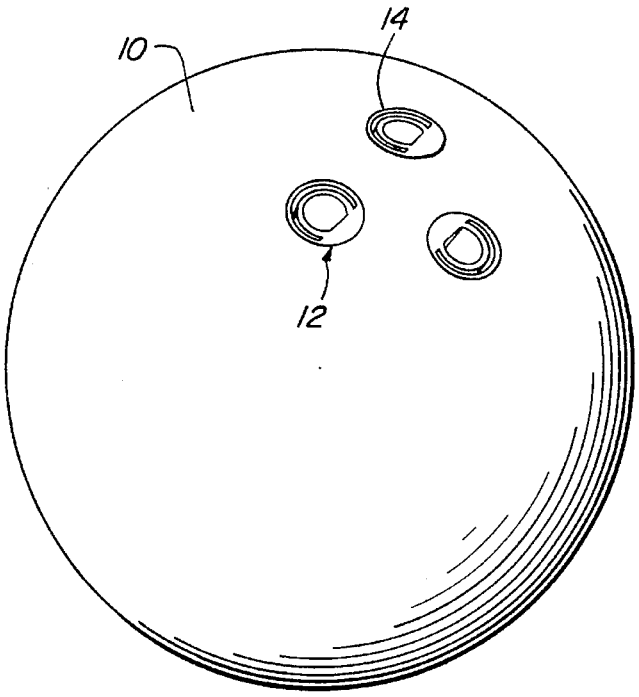
FIG. 1 shows a typical bowling ball equipped with inserts of the present invention.

FIG. 1 shows a bowling ball 10 equipped with inserts 12 of the present invention. Typically a bowling ball 10 has three finger holes 14 so that the bowling ball 10 can be handled with the thumb and the first two fingers of one hand. A top or proximal end 16 of each insert 12 is just flush with the surface of the bowling ball 10. Since the surface of the ball 10 is curved, the top end 16 of each insert 12 is preferably rounded to match the curve of the ball 10. Alternatively, the insert 12 can have a flat top end which is recessed slightly (not illustrated).

Figure 2:
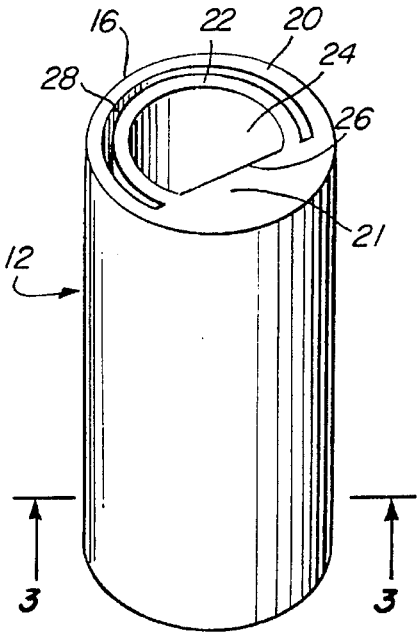
FIG. 2 shows an elevational view of the inserts of FIG. 1 removed from the bowling ball.
Figure 3:
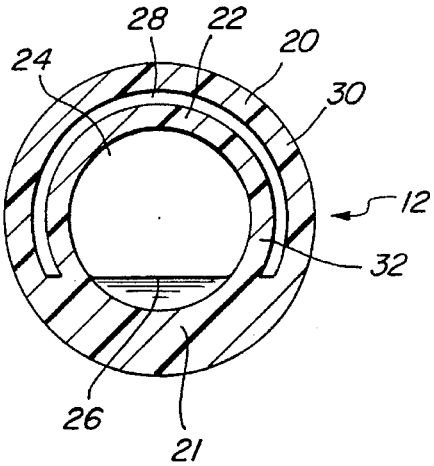
FIG. 3 shows a cross-section of the insert of FIG. 2.

In FIGS. 2 and 3 the inserts 12 can be seen to each comprise an outer cylinder 20 and an inner cylinder 22. A central aperture 24 is sized to accommodate a player's thumb or finger. A flat 26 is located on one side of the inner cylinder 22 to receive the flat ventral surface of the finger or thumb. The flat 26 tapers so that it extends only about one-half inch or so along the length of the central aperture 24. The inserts 12 of the present invention can be made having a uniform outer diameter of about 1¼ inches so that bowling balls 10 with uniform finger holes 14 of 1¼-inch diameter can be readily used with the inserts 12. Alternatively, the inserts 12 can be sized for any other convenient hole size.

As is well known in the art of bowling balls, finger sizes vary considerably from player to player. As a consequence, bowling balls are frequently drilled in 1/32-inch increments to accommodate various finger sizes. Similarly, the inserts 12 of the present invention can be made in increments of 1/32-inch to accommodate a wide range of bowlers. Of course, other size increments can be used. Since the finger holes 14 in the bowling ball 10 often remain at a fixed size, say 1¼ inches, it is relatively simple to replace the inserts 12 if different bowlers are to use the ball 10. Table 1 lists one popular range of the mean diameters of the central apertures 24 in the various-sized inserts 12.

TABLE 1

| DIAMETERS OF INNER APERTURE | |
|---|---|
| ½" | 13/16" |
| 17/32" | 27/32" |
| 9/16" | 14/16" |
| 19/32" | 15/16" |
| ⅝" | 31/32" |
| 21/32" | 1" |
| 11/16" | 1 1/32" |
| 23/32" | 1 1/16" |
| ¾" | 1 3/32" |
| 25/32" | 1⅛" |

In addition to varying in diameter as shown in Table 1, the inserts 12 of the present invention may also vary in length. There are three different ways that bowlers commonly grip their bowling balls 10. The traditional grip involves inserting essentially the entire length of the finger into the central aperture 24 of the insert 12. For this type of grip the inserts 12 are about two inches in length. Many bowlers grip their bowling balls 10 using only the tip (distal joint) of their fingers. For fingertip gripping inserts of one-inch length are produced. Finally, some extremely strong bowlers use only part of the fingertip; for this purpose semifingertip inserts about ⅜-inch in length are provided.

FIG. 3 shows a cross-section of a preferred embodiment of the present invention. The insert 12 is preferentially molded from polyurethane resin, although other elastomers such as natural rubber, silicone rubber, neoprene, vinyl, or other resilient polymeric materials can be employed. Softer materials such as most foams are not preferred for the present invention. A juncture 21, encompassing about 25% of the circumference of the inner cylinder 20, joins the inner cylinder 22 to the outer cylinder 20 along the length of the cylinders. Alternatively, a plurality of smaller longitudinal junctures 21 can be used (not shown).

An air space 28 separates the inner cylinder 22 from the outer cylinder 20. The central aperture 24 is sized to snugly fit the bowler's inserted finger. This snug fit is accomplished through the inner cylinder 22 stretching to encompass the finger. As is well known in the art of elastomers like polyurethane, these materials, while elastic and resilient, are practically incompressible. If the inner cylinder 22 is to expand, a space such as the air space 28 must be provided for such expansion. Expansion of the inner cylinder 22 is accommodated by shrinkage of the air space 28 which is vented to the atmosphere so that the air can escape as the air space 28 shrinks. Generally the air space 28 is open to the atmosphere at the proximal or top end 16 as is shown in FIG. 2.

This same expansion into the air space 28 automatically accommodates variations in finger size due to swelling or shrinkage of the finger. The degree of resiliency of the insert 12 is controlled by thickness of a wall 32 of the inner cylinder 22. The extent of accommodation is controlled by the size of the air space 28. That is, if the inner cylinder 22 has a relatively thin wall 32, that wall 32 will stretch more readily, providing a less firm grip on the inserted finger. If the wall 32 is thicker, it will be more difficult to stretch, causing it to be more difficult to insert and remove the finger.

If the air space 28 is too small, the degree of expansion of the inner cylinder 22 will be restricted. If the air space 28 is too large, the inner cylinder 22 with the inserted finger will tend to move around excessively within the outer cylinder 20. Clearly, all these parameters are interrelated, since the outer diameter of the insert 12 remains constant. As the central aperture 24 is enlarged to accommodate larger fingers, either thickness of the inner wall 32, the air space 28, or thickness of the outer wall 30 must change. In practical use, a range of insert sizes can have relatively constant thicknesses of the inner wall 32 and the air space 28, with the outer wall 30 being adjusted in thickness to come up to the 1¼-inch (or other) desired hole diameter. Since larger fingers will show a larger change in diameter with swelling or shrinking, it may be desirable to make the air space 28 somewhat larger in the larger insert sizes. The size of the juncture(s) 21 can also be adjusted to control the size of the air space 28 and the compliance of the inner cylinder 22.

Figure 4:
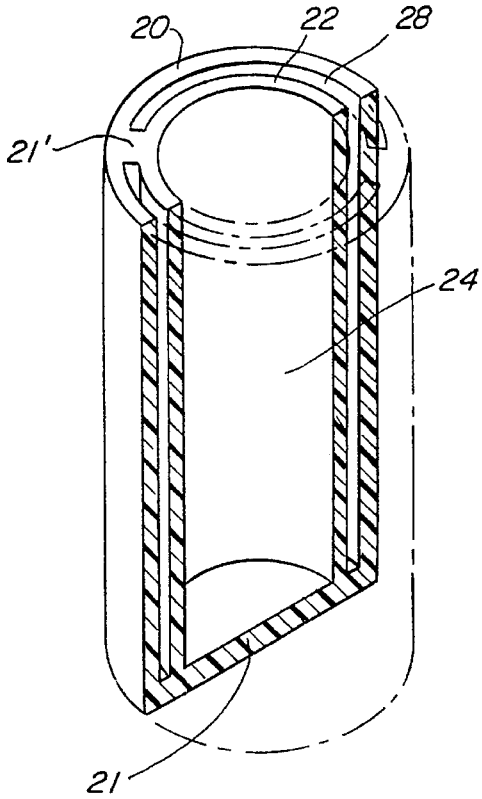
FIG. 4 shows a longitudinal section of an alternate embodiment of the present invention.

FIG. 4 shows a longitudinal section through an alternative embodiment of the insert 12. Here the outer cylinder 20 and the inner cylinder 22 are almost entirely separate. The juncture 21 occurs only at the distal ends of the cylinders. Resiliency of the inner cylinder 20 holds that cylinder in place during finger insertion. Alternatively, it may be desirable to add one or more small additional junctures 21' near the top end 16 of the insert to further stabilize the position of inner cylinder 22 during finger insertion. By allowing the air space 28 to completely encircle the central aperture 24, the embodiment of FIG. 3 permits greater compliance of the inner cylinder 22, especially if the inner wall 32 is relatively thin. This property is more useful with the full-length (two-inch) insert 12, which must accommodate two finger joints. While a reverse configuration might be contemplated in which the main juncture 21 is placed near the proximal or top end 16 of the insert 12, such a design is generally not preferred because it acts to restrict the passage of a large knuckle joint.

The inserts 12 of the present invention are installed by being glued into the finger holes 14 of a bowling ball 10. Generally, elastomers such as polyurethane are difficult to glue because most adhesives will not adhere to them. However, Applicant has found that adequate adherence of polyurethane can be achieved by using a gel formulation of cyanoacrylate. Inserts 12 made from other elastomers will require different adhesives for optimal results.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

The invention claimed is:

1. A deformable insert for a bowling ball, sized to fit within a finger hole of the ball and sized to receive a bowler's finger placed within the insert, the insert comprising:

an outer hollow cylinder of a deformable elastomer, an outer surface of the cylinder disposed to contact the bowling ball within the finger hole;

an inner hollow cylinder also of deformable elastomer, the inner cylinder coaxial with the outer cylinder and disposed within the outer cylinder, a central aperture of the inner cylinder sized to receive the bowler's finger;

an air space separating the inner cylinder from the outer cylinder, the air space serving to accept an increase of volume of the inner cylinder when the inner cylinder is deformed by insertion of the bowler's finger; and a juncture between the inner cylinder and the outer cylinder, the juncture serving to prevent separation of the inner cylinder from the outer cylinder when the bowler's finger is inserted into and pulled from the central aperture.

2. The deformable insert of claim 1, wherein the juncture extends laterally along a length of the insert.

3. The deformable insert of claim 1, wherein the central aperture bears a flat region at a proximal end of the inner cylinder, the flat region sized and positioned to interact with a ventral surface of the bowler's finger when the finger is inserted into the insert.

4. The deformable insert of claim 1, wherein the juncture is located at a distal end of the insert.

5. The deformable insert of claim 1, wherein the elastomer is selected from the group consisting of polyurethane, silicone rubber, natural rubber, neoprene, and vinyl.

6. A deformable insert for a bowling ball, sized to fit within a finger hole of the ball and sized to receive a bowler's finger placed within the insert, the insert comprising:

an outer hollow cylinder of a deformable elastomer sized to fit within a finger hole, an outer surface of the cylinder disposed to contact and to be affixed to the bowling ball within the finger hole;

an inner hollow cylinder also of deformable elastomer, the inner cylinder substantially coaxial with the outer cylinder and disposed within the outer cylinder, a central aperture of the inner cylinder sized to receive the bowler's finger when inserted into the central aperture;

an air space separating the inner cylinder from the outer cylinder, the air space serving to accept an increase of volume of the inner cylinder when the inner cylinder is deformed by insertion of the bowler's finger and having a connection to the atmosphere to allow free exchange of air; and a juncture between the inner cylinder and the outer cylinder running along a length of the cylinders and interrupting the air space, the juncture serving to prevent separation of the inner cylinder from the outer cylinder when the bowler's finger is inserted into and pulled from the central aperture.

7. The deformable insert of claim 6, wherein the central aperture bears a flat region at a proximal end of the inner cylinder, the flat region sized and positioned to interact with a ventral surface of the bowler's finger when the finger is inserted into the insert.

8. The deformable insert of claim 7, wherein the flat region and the juncture are at substantially coincident positions along a circumference of the inner cylinder.

9. The deformable insert of claim 7, wherein the elastomer is selected from the group consisting of polyurethane, silicone rubber, natural rubber, neoprene, and vinyl.

10. A deformable insert for a bowling ball, sized to fit within a finger hole of the ball and sized to receive a bowler's finger placed within the insert, the insert comprising:

an outer hollow cylinder of a deformable elastomer sized to fit within a finger hole, an outer surface of the cylinder disposed to contact and to be affixed to the bowling ball within the finger hole;

an inner hollow cylinder also of deformable elastomer, the inner cylinder substantially coaxial with the outer cylinder and disposed within the outer cylinder, a central aperture of the inner cylinder sized to receive the bowler's finger when inserted into the central aperture;

an air space separating the inner cylinder from the outer cylinder, the air space serving to accept an increase of volume of the inner cylinder when the inner cylinder is deformed by insertion of the bowler's finger and having a connection to the atmosphere to allow free exchange of air; and a juncture between the inner cylinder and the outer cylinder located at a distal end of the inner cylinder, the juncture serving to prevent separation of the inner cylinder from the outer cylinder when the bowler's finger is inserted into and pulled from the central aperture.

11. The deformable insert of claim 10, wherein the central aperture bears a flat region at a proximal end of the inner cylinder, the flat region sized and positioned to interact with a ventral surface of the bowler's finger when the finger is inserted into the insert.

12. The deformable insert of claim 11 further comprising a second juncture located at a proximal end of the inner cylinder.

13. The deformable insert of claim 10, wherein the elastomer is selected from the group consisting of polyurethane, silicone rubber, natural rubber, neoprene, and vinyl.

* * * * *